US011417948B1

(12) United States Patent
Pan et al.

(10) Patent No.: US 11,417,948 B1
(45) Date of Patent: Aug. 16, 2022

(54) ANTENNA DEVICE

(71) Applicant: WISTRON NEWEB CORPORATION, Hsinchu (TW)

(72) Inventors: Han-Chang Pan, Hsinchu (TW); Shih-Hong Chen, Hsinchu (TW); Chih-Lung Chen, Hsinchu (TW); Li-Jun Chen, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 0 days.

(21) Appl. No.: 17/406,143

(22) Filed: Aug. 19, 2021

(30) Foreign Application Priority Data

Jan. 22, 2021 (TW) ..... 110102426

(51) Int. Cl.
*H01Q 1/36* (2006.01)

(52) U.S. Cl.
CPC ..... *H01Q 1/36* (2013.01)

(58) Field of Classification Search
CPC ..... H01Q 1/243; H01Q 1/36; H01Q 1/38; H01Q 1/40; H01Q 1/42; H01Q 1/422; H01L 31/1884; H01L 31/022466
See application file for complete search history.

(56) References Cited

U.S. PATENT DOCUMENTS 8,608,080 B2 * 12/2013 Finn ..... B42D 15/00 235/487
2009/0051620 A1 2/2009 Ishibashi et al.
2010/0197068 A1 * 8/2010 Poon ..... H01L 31/022483 977/762
2012/0024572 A1 * 2/2012 Naoi ..... B82Y 30/00 977/762
2015/0315708 A1 * 11/2015 Radi ..... B32B 15/043 427/259
2020/0141993 A1 * 5/2020 Nikic ..... G01R 31/1263

FOREIGN PATENT DOCUMENTS

CN 101140634 A 3/2008
TW M461158 U1 9/2013

* cited by examiner

*Primary Examiner* — Thai Pham
(74) *Attorney, Agent, or Firm* — McClure, Qualey & Rodack, LLP

(57) ABSTRACT

An antenna device is provided. The antenna device includes an antenna layer, a first transparent layer, and a second transparent layer. The antenna layer is a metal mesh structure having a plurality of thru-holes, and the antenna layer includes at least one soldering region and an embedded region. The first transparent layer and the second transparent layer are respectively connected to two opposite sides of the antenna layer. The first transparent layer and the second transparent layer are connected to each other, so that the embedded region of the antenna layer is embedded in-between the first transparent layer and the second transparent layer. The second transparent layer has a hollow region corresponding in position to the at least one soldering region, so that the at least one soldering region is exposed from the hollow region.

16 Claims, 10 Drawing Sheets

ANTENNA DEVICE

CROSS-REFERENCE TO RELATED PATENT APPLICATION

This application claims the benefit of priority to Taiwan Patent Application No. 110102426, filed on Jan. 22, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna device, and more particularly to an antenna device having a waterproof function.

BACKGROUND OF THE DISCLOSURE

Due to being limited to an existing framework, a conventional antenna structure fails to have a wider application scope. For example, the conventional antenna structure is mostly opaque and does not have any waterproof function.

SUMMARY OF THE DISCLOSURE

In response to the above-referenced technical inadequacy, the present disclosure provides an antenna device to effectively improve on the issues associated with conventional antenna structures.

In one aspect, the present disclosure provides an antenna device, which includes an antenna layer, a first transparent layer, and a second transparent layer. The antenna layer is a metal mesh structure having a plurality of thru-holes, and the antenna layer includes at least one soldering region and an embedded region. The first transparent layer and the second transparent layer are respectively connected to two opposite sides of the antenna layer. The first transparent layer and the second transparent layer are connected to each other, so that the embedded region of the antenna layer is embedded in-between the first transparent layer and the second transparent layer. The second transparent layer has a hollow region corresponding in position to the at least one soldering region, so that the at least one soldering region is exposed from the hollow region.

Therefore, by using the structural design of the antenna layer cooperatively with the first transparent layer and the second transparent layer, the antenna device of the present disclosure is formed to be transparent as a whole and has a wider application. In addition, the antenna layer is sealed in-between the first transparent layer and the second transparent layer to have a waterproof function (or a water vapor resistance function), so that a radiation efficiency of the antenna device can be effectively maintained during use.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
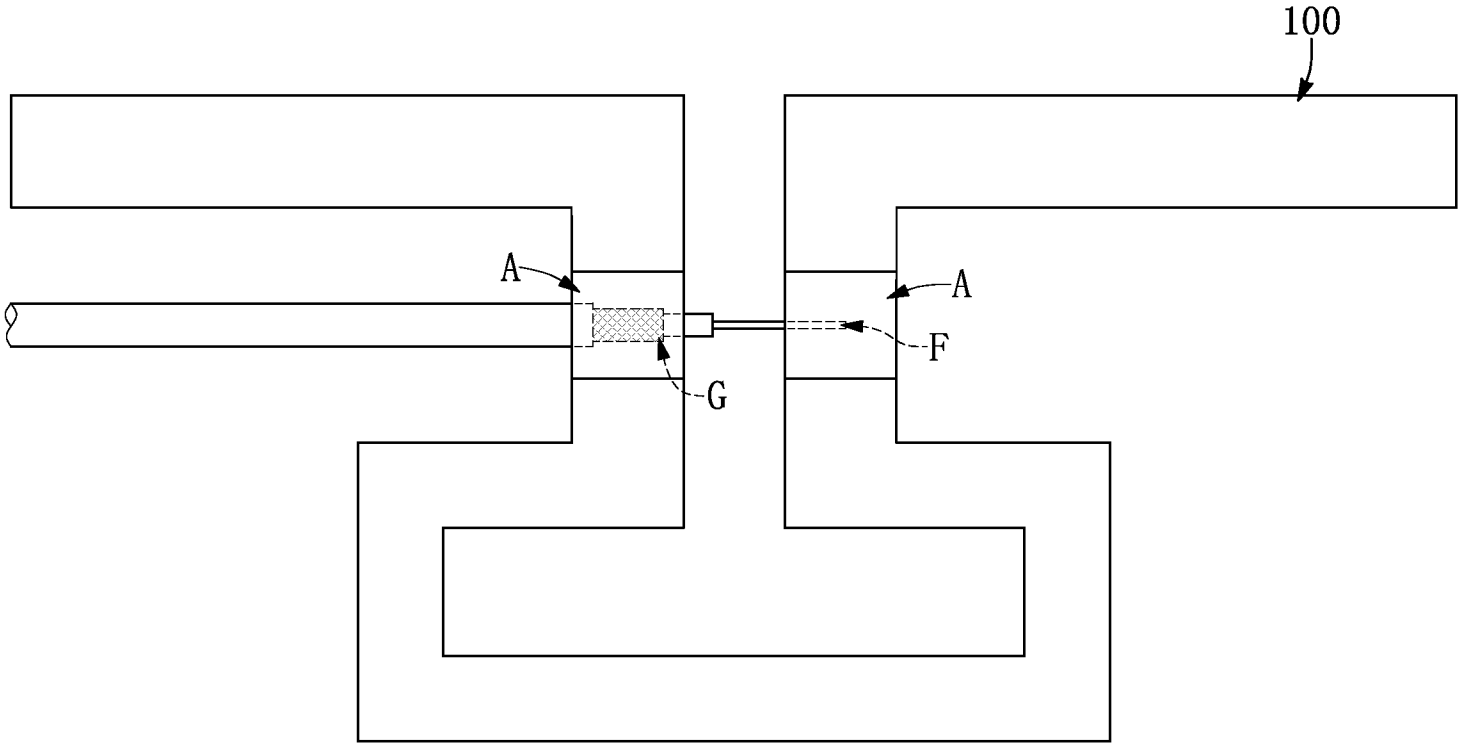
FIG. 1 is a schematic view showing an antenna device being connected to a feeding end and a grounding end according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 7, a first embodiment of the present disclosure provides an antenna device 100 having a waterproof function (or a water vapor resistance function).

Figure 2:
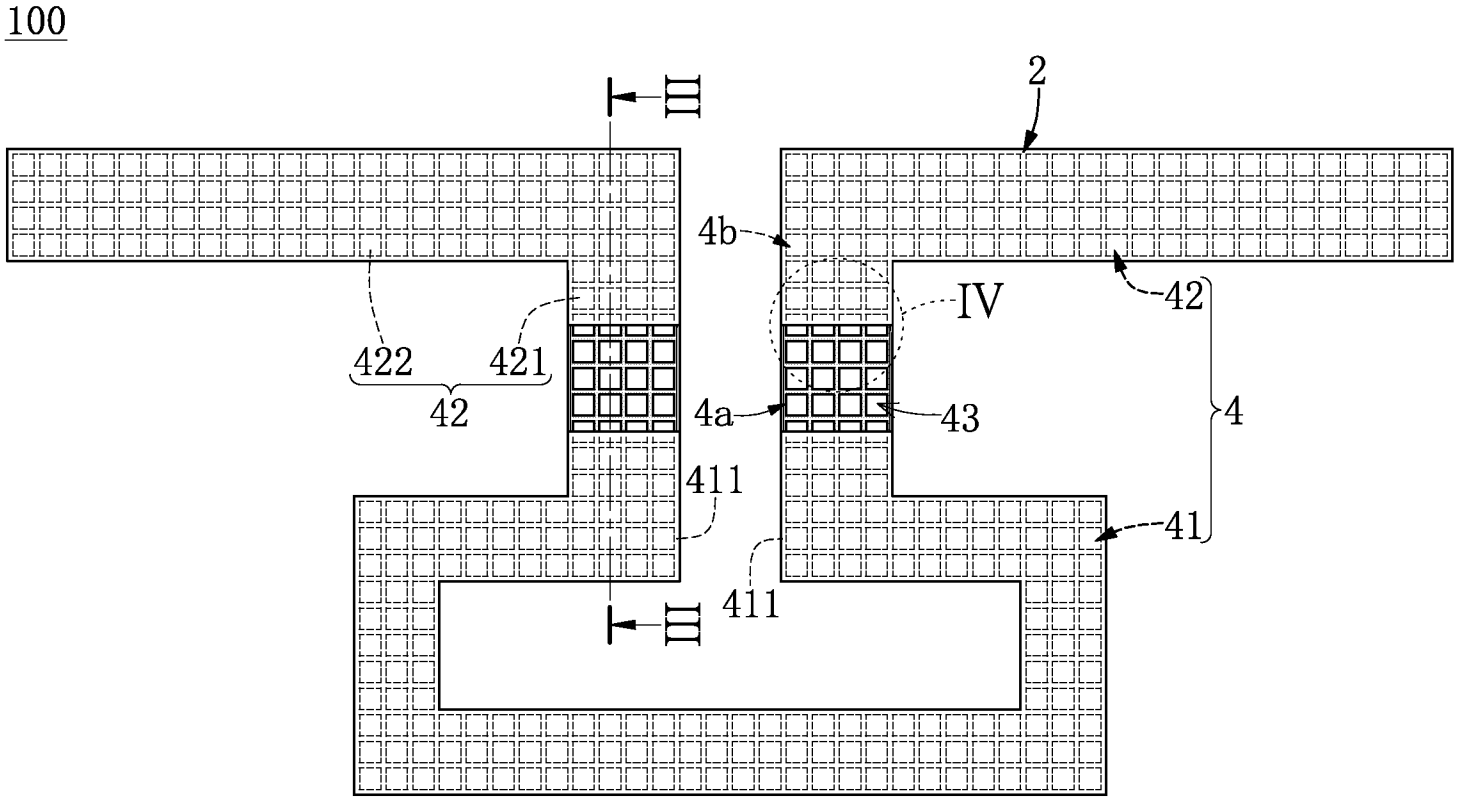
FIG. 2 is a schematic view of the antenna device according to the first embodiment of the present disclosure.
Figure 3:
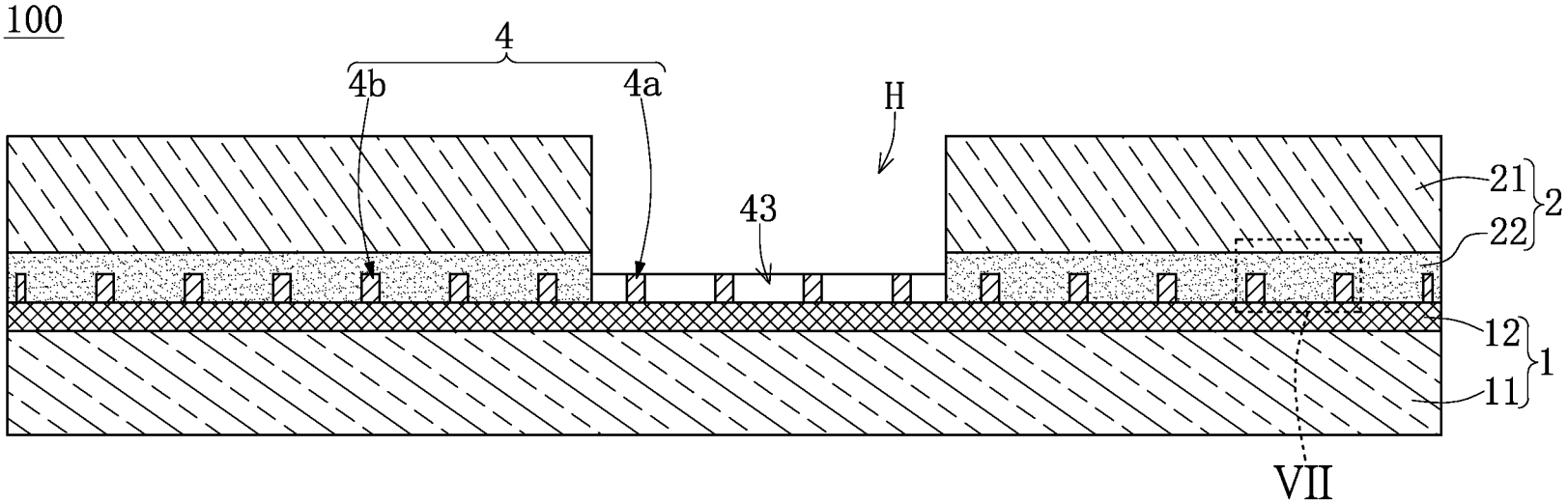
FIG. 3 is a cross-sectional view taken along line III-III of FIG. 2.

As shown from FIG. 1 to FIG. 3, the antenna device 100 in the present embodiment includes an antenna layer 4, a first transparent layer 1, and a second transparent layer 2. The first transparent layer 1 and the second transparent layer 2 are respectively connected to two opposite sides of the antenna layer 4.

Figure 4:
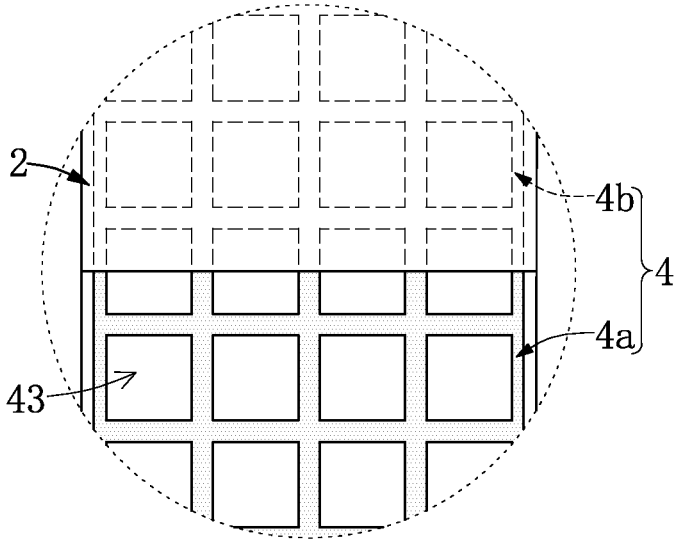
FIG. 4 shows an enlarged view of part IV of FIG. 2.
Figure 5:
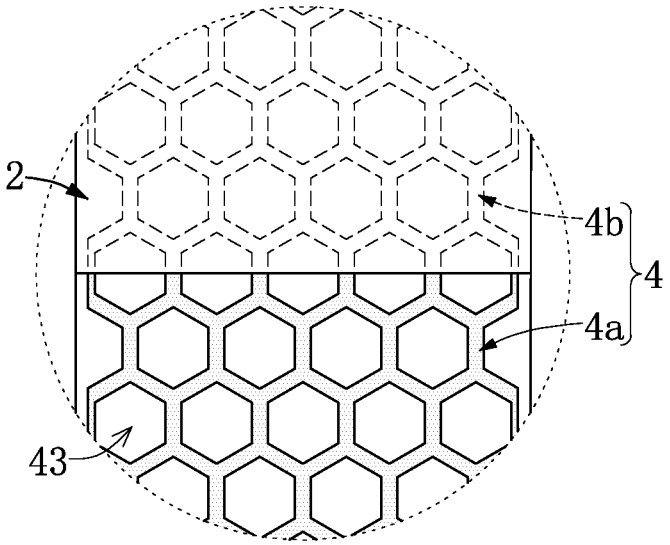
FIG. 5 shows another configuration of FIG. 4.
Figure 6:
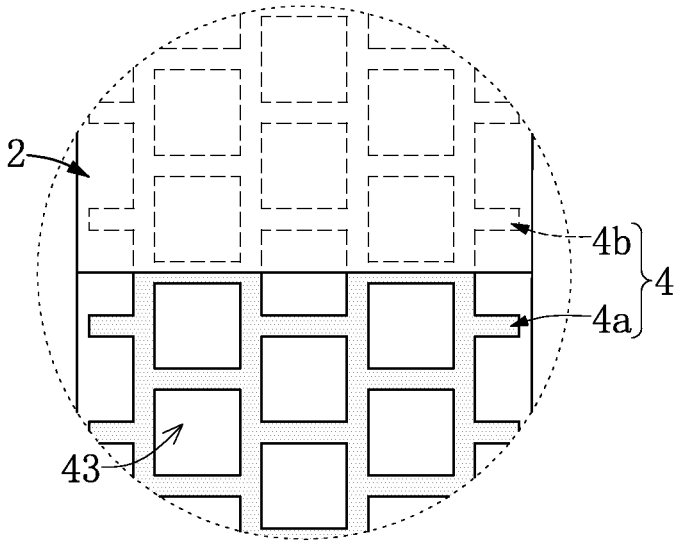
FIG. 6 shows still another configuration of FIG. 4.

As shown from FIG. 2 to FIG. 4, the antenna layer 4 is a metal mesh structure having a plurality of thru-holes 43, and an open ratio of the thru-holes 43 of the antenna layer 4 in the present embodiment is within a range from 60% to 99%. Moreover, the open ratio in the present embodiment indicates that the thru-holes 43 occupy 60% to 99% of an area surrounded by an outer contour of the antenna layer 4.

Accordingly, in the antenna device 100 of the present embodiment, the thru-holes 43 are configured to allow light to pass through the antenna layer 4, such that the antenna layer 4 having the open ratio is substantially transparent. In other words, the open ratio of the antenna layer 4 can be adjusted or changed to a predetermined value according to design requirements (e.g., a transparency of the antenna layer 4).

Moreover, the thru-holes 43 of the antenna layer 4 have a regular arrangement, and at least 80% of the thru-holes 43 have a same size and are in a same regular polygon shape. For example, each of the thru-holes 43 can be in a square shape shown in FIG. 4 or a hexagon shape shown in FIG. 5; or, the thru-holes 43 can have a matrix arrangement shown in FIG. 4 or a staggered arrangement shown in FIG. 6.

Figure 7:
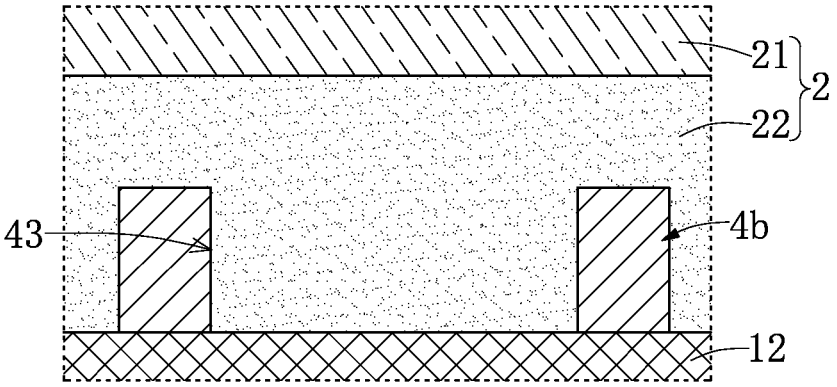
FIG. 7 shows an enlarged view of part VII of FIG. 3.

In the present embodiment, as shown in FIG. 2, FIG. 3, and FIG. 7, the antenna layer 4 includes a C-shaped segment 41 and two L-shaped segments 42 that are connected to the C-shaped segment 41. The C-shaped segment 41 includes two end portions 411 facing each other. Each of the two L-shaped segments 42 includes a short radiating portion 421 and a long radiating portion 422. Ends of the two short radiating portions 421 (e.g., lower ends of the two short radiating portions 421 shown in FIG. 2) away from the two long radiating portions 422 are respectively connected to the two end portions 411, and the two long radiating portions 422 respectively extend from another ends of the two short radiating portions 421 (e.g., upper ends of the two short radiating portions 421 shown in FIG. 2) along two opposite directions.

Specifically, the two L-shaped segments 42 are configured to be mirror-symmetrical with respect to one another, and a distance between the two L-shaped segments 42 is equal to a distance between the two end portions 411, but the present disclosure is not limited thereto. The short radiating portion 421 of each of the two L-shaped segments 42 is perpendicularly connected to the corresponding end portion 411 of the C-shaped segment 41.

In other words, the antenna layer 4 includes two soldering regions 4*a* and an embedded region 4*b*. The first transparent layer 1 and the second transparent layer 2 are connected to each other, so that the embedded region 4*b* of the antenna layer 4 is embedded in-between the first transparent layer 1 and the second transparent layer 2. In the present embodiment, a size of the first transparent layer 1 is substantially identical to a size of the second transparent layer 2, and a peripheral portion of the second transparent layer 2 is connected to and is flush with a peripheral portion of the first transparent layer 1, but the present disclosure is not limited thereto. For example, in other embodiments of the present disclosure (not shown in the drawings), the size of the first transparent layer 1 can be larger than the size of the second transparent layer 2, so that the second transparent layer 2 is connected to a non-peripheral portion of the first transparent layer 1.

Moreover, the second transparent layer 2 includes two hollow regions H respectively corresponding in position to the two soldering regions 4*a*, and the two soldering regions 4*a* are exposed from the two hollow regions H of the second transparent layer 2, respectively (e.g., the two soldering regions 4*a* are exposed to air). In this way, the two soldering regions 4*a* can be connected to a feeding end F and a grounding end G, respectively. In addition, after the two soldering regions 4*a* are respectively connected to the feeding end F and the grounding end G, a waterproof colloid A can be used to cover the two soldering regions 4*a*, the feeding end F, and the grounding end G, thereby effectively establishing the waterproof function (or the water vapor resistance function).

The two hollow regions H can be formed in the second transparent layer 2 after the second transparent layer 2 and the first transparent layer 1 are connected to each other; or, the two hollow regions H can be formed in the second transparent layer 2 before the second transparent layer 2 and the first transparent layer 1 are connected to each other, but the present disclosure is not limited thereto.

In the present embodiment, the two soldering regions 4*a* are respectively arranged on the two short radiating portions 421, and the rest of the antenna layer 4 (other than the two soldering regions 4*a*) can be regarded as the embedded region 4*b*. In other words, a region of the antenna layer 4 other than the two soldering regions 4*a* is embedded in-between the first transparent layer 1 and the second transparent layer 2.

In addition, the antenna device 100 of the present embodiment is described according to a structure shown in FIG. 2 to FIG. 7, but the present disclosure is not limited thereto. For example, in other embodiments of the present disclosure (not shown in the drawings), a quantity of the soldering region 4*a* of the antenna layer 4 can be at least one, and the second transparent layer 2 has a hollow region H corresponding in position to the at least one soldering region 4*a*, so that the at least one soldering region 4*a* is exposed from the hollow region H (e.g., the at least one soldering region 4*a* is exposed to air), and a region of the antenna layer 4 other than the at least one soldering region 4*a* is embedded in-between the first transparent layer 1 and the second transparent layer 2.

It should be noted that a light transmittance of each of the first transparent layer 1 and the second transparent layer 2 with respect to a visible light (having a wavelength within a range from 380 nm to 780 nm) is preferably at least 70%. Moreover, the first transparent layer 1 and the second transparent layer 2 of the present embodiment can have features described in the following description, so as to enable the antenna device 100 to have a better waterproof effect, but the present disclosure is not limited thereto.

The first transparent layer 1 includes a first substrate 11 and a buffering layer 12. The first substrate 11 is connected to the antenna layer 4 through the buffering layer 12. Moreover, a coefficient of thermal expansion (CTE) of the buffering layer 12 is within a range from a CTE of the antenna layer 4 to a CTE of the first substrate 11.

Specifically, a water vapor transmission rate (WVTR) of the first substrate 11 is less than 40 $g/m^2 \cdot day$, and an oxygen transmission rate (OTR) of the first substrate 11 is less than 550 $cm^3/m^2 \cdot day$. For example, the first substrate 1 can be a polymer plastic layer or a glass layer, and the buffering layer 12 can be an oxide layer, a polymer layer, or a composite layer that includes an oxide layer or a polymer layer.

The second transparent layer 2 includes a second substrate 21 and an adhesive layer 22. The second substrate 21 is connected to the embedded region 4*b* of the antenna layer 4 through the adhesive layer 22. Any one of the thru-holes 43 located at the embedded region 4*b* is filled with a part of the adhesive layer 22, and is defined by a wall that is gaplessly connected to the part of the adhesive layer 22. Moreover, a CTE of the adhesive layer 22 is within a range from the CTE of the antenna layer 4 to a CTE of the second substrate 21.

Specifically, a WVTR of the second substrate 21 is less than 40 $g/m^2 \cdot day$, and an OTR of the second substrate 21 is less than 550 $cm^3/m^2 \cdot day$. Moreover, a difference between the CTE of the first substrate 11 and the CTE of the second substrate 21 is less than $50 \times 10^{-5}/°$ C. For example, the second substrate 21 can be a polymer plastic layer, a polymer coating layer, or a glass layer.

Accordingly, by using the structural design of the antenna layer 4 cooperatively with the first transparent layer 1 and the second transparent layer 2, the antenna device 100 of the present embodiment is formed to be transparent as a whole and has a wider application. In addition, the antenna layer 4 in the present embodiment can be sealed in-between the first transparent layer 1 and the second transparent layer 2 to have the waterproof function (or the water vapor resistance function), so that a radiation efficiency of the antenna device 100 can be effectively maintained during use (e.g., results of an environment test shown in a table below).

| Product under test | Test condition | Average antenna radiation efficiency in whole frequency band | Loss ratio of the radiation efficiency after test |
|---|---|---|---|
| The antenna layer of the present embodiment | New product without any test | 62.2% | −31.5% |
| | New product under a test condition of 80° C./72 Hours | 42.6% | |
| The antenna device of the present embodiment | New product without any test | 59.4% | −16.8% |
| | New product under a test condition of 80° C./72 Hours | 49.5% | |

In addition, the antenna device 100 of the present embodiment is described according to a structure shown from FIG. 2 to FIG. 7, but the present disclosure is not limited thereto. For example, in other embodiments of the present disclosure (not shown in the drawings), the second transparent layer 2 can be directly formed and solidified onto the first transparent layer 1 by being made of a transparent material (e.g., a polymer coating layer), so that the antenna layer 4 is embedded in-between the first transparent layer 1 and the second transparent layer 2.

Second Embodiment

Figure 8:
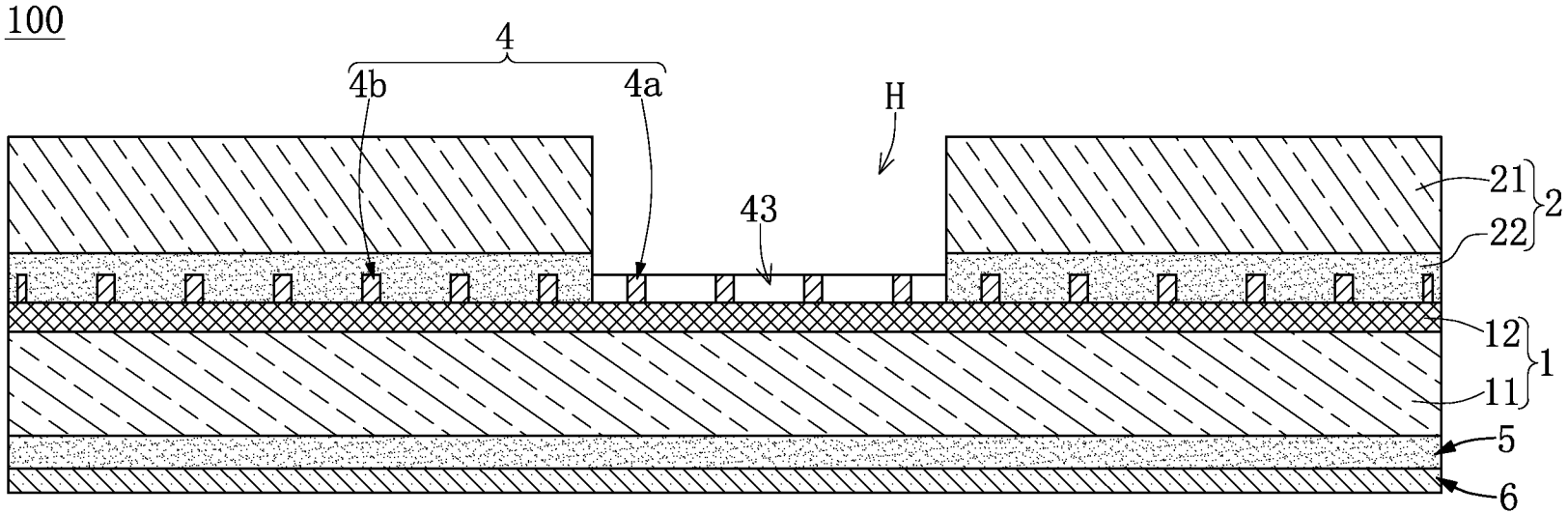
FIG. 8 is a cross-sectional view of the antenna device according to a second embodiment of the present disclosure.

Referring to FIG. 8, a second embodiment of the present disclosure is similar to the first embodiment of the present disclosure. For the sake of brevity, descriptions of the same components in the first and second embodiments of the present disclosure will be omitted herein, and the following description only discloses different features between the first and second embodiments.

In the present embodiment, the antenna device 100 further includes a bonding layer 5 and a release film 6. The bonding layer 5 is formed on a surface of the first transparent layer 1 (e.g., a bottom surface of the first substrate 11 shown in FIG. 8) away from the antenna layer 4, and the release film 6 is detachably connected to the bonding layer 5.

Accordingly, the antenna device 100 in the present embodiment is provided by forming the bonding layer 5 onto the first transparent layer 1, so that the antenna device 100 can be easily fixed to a predetermined position according to user requirements for effectively improving the convenience of using the antenna device 100.

Third Embodiment

Figure 9:
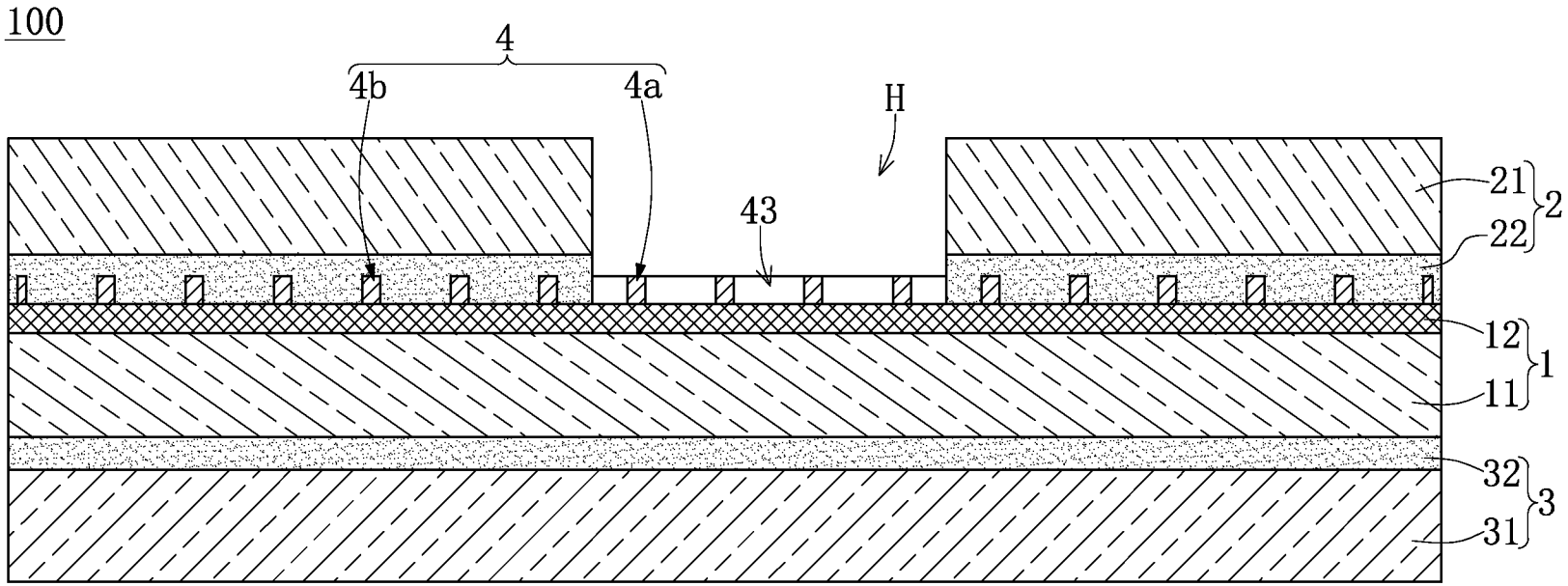
FIG. 9 is a cross-sectional view of the antenna device according to a third embodiment of the present disclosure.

Referring to FIG. 9, a third embodiment of the present disclosure is similar to the first embodiment of the present disclosure. For the sake of brevity, descriptions of the same components in the first and third embodiments of the present disclosure will be omitted herein, and the following description only discloses different features between the first and third embodiments.

In the present embodiment, a thickness of the first substrate 11 is limited to being within a range from 5 μm to 300 μm. The antenna device 100 further includes a third transparent layer 3 connected to a surface of the first substrate 11 (e.g., a bottom surface of the first substrate 11 shown in FIG. 9) away from the antenna layer 4, thereby increasing a structural strength of the antenna device 100.

The third transparent layer 3 includes a third substrate 31 and an adhering layer 32, and the third substrate 31 is connected to the first substrate 11 through the adhering layer 32. Moreover, a thickness of the third substrate 31 is within a range from 10 μm to 1000 μm, a WVTR of the third substrate 31 is less than 40 $g/m^2 \cdot day$, and an OTR of the third substrate 31 is less than 550 $cm^3/m^2 \cdot day$. Specifically, a difference between the CTE of the first substrate 11 and a CTE of the third substrate 31 is less than $50 \times 10^{-5}/°$ C. For example, the third substrate 31 can be a polymer plastic layer, a polymer coating layer, or a glass layer.

Accordingly, the antenna device 100 in the present embodiment is provided by forming the third transparent layer 3 onto the first transparent layer 1, so that the radiation efficiency of the antenna device 100 can be further maintained during use (e.g., results of an environment test shown in a table below).

| Product under test | Test condition | Average antenna radiation efficiency in whole frequency band | Loss ratio of the radiation efficiency after test |
|---|---|---|---|
| The antenna layer of the present embodiment | New product without any test | 62.2% | −31.5% |
| | New product under a test condition of 80° C./72 Hours | 42.6% | |
| The antenna device of the present embodiment | New product without any test | 58.2% | −0.3% |
| | New product under a test condition of 80° C./72 Hours | 58.0% | |

In addition, the antenna device 100 of the present embodiment is described according to a structure shown in FIG. 9, but the present disclosure is not limited thereto. For example, in other embodiments of the present disclosure (not shown in the drawings), the third transparent layer 3 can be directly formed and solidified onto the surface of the first transparent layer 1 that is away from the antenna layer 4 by being made of a transparent material (e.g., a polymer coating layer).

Fourth Embodiment

Figure 10:
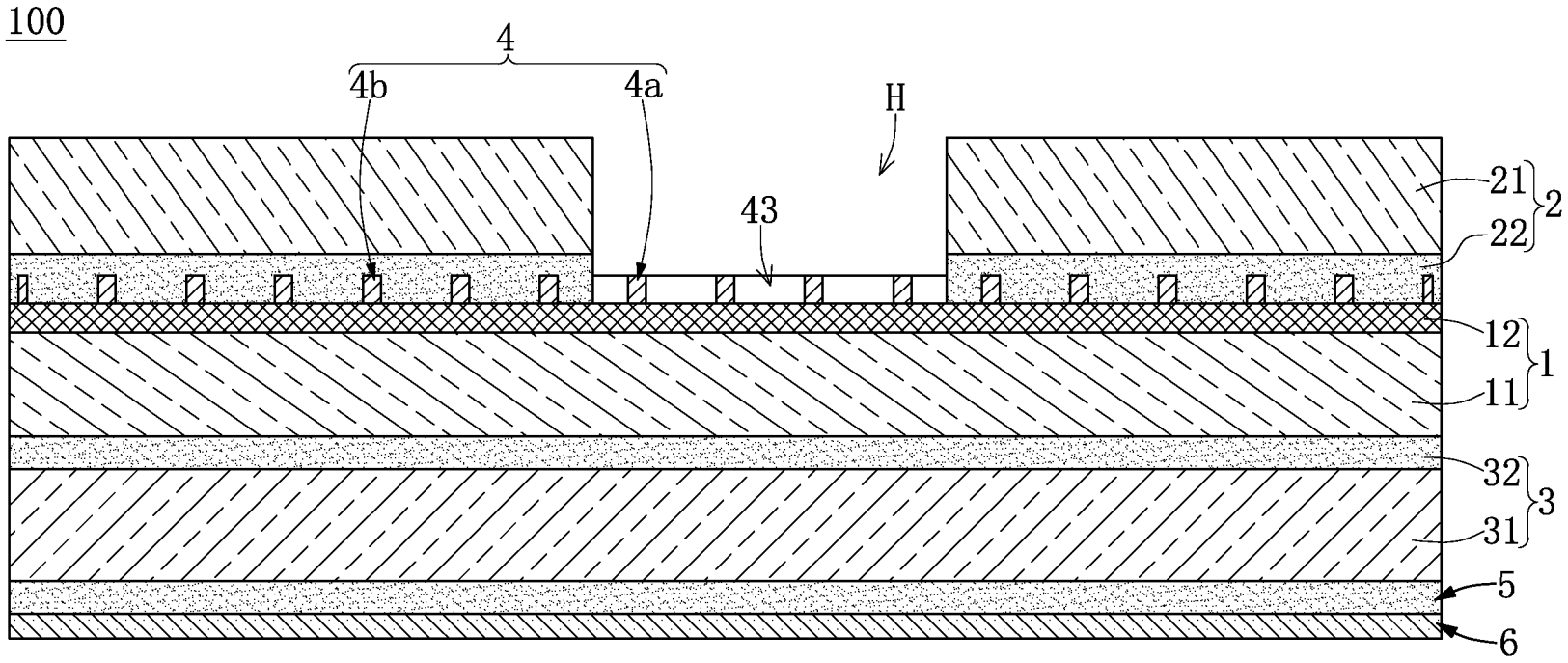
FIG. 10 is a cross-sectional view of the antenna device according to a fourth embodiment of the present disclosure.

Referring to FIG. 10, a fourth embodiment of the present disclosure is similar to the third embodiment of the present disclosure. For the sake of brevity, descriptions of the same components in the third and fourth embodiments of the present disclosure will be omitted herein, and the following description only discloses different features between the third and fourth embodiments.

In the present embodiment, the antenna device 100 further includes a bonding layer 5 and a release film 6. The bonding layer 5 is formed on a surface of the third transparent layer 3 (e.g., a bottom surface of the third substrate 31 shown in FIG. 10) away from the antenna layer 4, and the release film 6 is detachably connected to the bonding layer 5.

Accordingly, the antenna device 100 in the present embodiment is provided by forming the bonding layer 5 onto the third transparent layer 3, so that the antenna device 100 can be easily fixed to a predetermined position according to user requirements for effectively improving the convenience of using the antenna device 100.

Beneficial Effects of the Embodiments

In conclusion, by using the structural design of the antenna layer cooperatively with the first transparent layer and the second transparent layer, the antenna device of the present disclosure is formed to be transparent as a whole and has a wider application. In addition, the antenna layer in the present disclosure is sealed in-between the first transparent layer and the second transparent layer to have the waterproof function (or the water vapor resistance function), so that a radiation efficiency of the antenna device can be effectively maintained during use.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An antenna device, comprising:

an antenna layer being a metal mesh structure having a plurality of thru-holes, wherein the antenna layer includes at least one soldering region and an embedded region; and a first transparent layer and a second transparent layer respectively connected to two opposite sides of the antenna layer, wherein the first transparent layer and the second transparent layer are connected to each other, so that the embedded region of the antenna layer is embedded in-between the first transparent layer and the second transparent layer;

wherein the second transparent layer has a hollow region corresponding in position to the at least one soldering region, so that the at least one soldering region is exposed from the hollow region.

2. The antenna device according to claim 1, wherein a light transmittance of the first transparent layer with respect to a visible light is at least 70%, the first transparent layer includes a first substrate and a buffering layer, and the first substrate is connected to the antenna layer through the buffering layer, and wherein a coefficient of thermal expansion (CTE) of the buffering layer is within a range from a CTE of the antenna layer to a CTE of the first substrate.

3. The antenna device according to claim 2, wherein the first substrate is a polymer plastic layer or a glass layer, and the buffering layer is an oxide layer, a polymer layer, or a composite layer that includes an oxide layer or a polymer layer.

4. The antenna device according to claim 2, wherein a light transmittance of the second transparent layer with respect to the visible light is at least 70%, the second transparent layer includes a second substrate and an adhesive layer, and the second substrate is connected to the embedded region of the antenna layer through the adhesive layer, and wherein a CTE of the adhesive layer is within a range from the CTE of the antenna layer to a CTE of the second substrate.

5. The antenna device according to claim 4, wherein a difference between the CTE of the first substrate and the CTE of the second substrate is less than $50\times10^{-5}/°$ C.

6. The antenna device according to claim 4, wherein any one of the thru-holes located at the embedded region is filled with a part of the adhesive layer, and is defined by a wall that is gaplessly connected to the part of the adhesive layer.

7. The antenna device according to claim 4, wherein the second substrate is a polymer plastic layer, a polymer coating layer, or a glass layer.

8. The antenna device according to claim 4, wherein a water vapor transmission rate (WVTR) of the first substrate is less than 40 g/m2·day, an oxygen transmission rate (OTR) of the first substrate is less than 550 cm3/m2·day, a WVTR of the second substrate is less than 40 g/m2·day, and an OTR of the second substrate is less than 550 $cm^3/m^2$·day.

9. The antenna device according to claim 2, wherein a thickness of the first substrate is within a range from 5 μm to 300 μm, and the antenna device includes a third transparent layer connected to a surface of the first substrate that is away from the antenna layer.

10. The antenna device according to claim 9, wherein a light transmittance of the third transparent layer with respect to the visible light is at least 70%, the third transparent layer includes a third substrate and an adhering layer, and the third substrate is connected to the first substrate through the adhering layer, and wherein a difference between the CTE of the first substrate and a CTE of the third substrate is less than $50\times10^{-5}/°$ C.

11. The antenna device according to claim 10, wherein the third substrate is a polymer plastic layer, a polymer coating layer, or a glass layer, and a thickness of the third substrate is within a range from 10 μm to 1000 μm.

12. The antenna device according to claim 1, further comprising a bonding layer and a release film, wherein the bonding layer is formed on a surface of the first transparent layer that is away from the antenna layer, and the release film is detachably connected to the bonding layer.

13. The antenna device according to claim 1, wherein a region of the antenna layer other than the at least one soldering region is embedded in-between the first transparent layer and the second transparent layer.

14. The antenna device according to claim 1, wherein an open ratio of the thru-holes of the antenna layer is within a range from 60% to 99%.

15. The antenna device according to claim 1, wherein the thru-holes of the antenna layer have a regular arrangement, and at least 80% of the thru-holes have a same size and are in a same regular polygon shape.

16. The antenna device according to claim 1, wherein the antenna layer includes:

a C-shaped segment including two end portions facing each other; and two L-shaped segments each including a short radiating portion and a long radiating portion, wherein ends of the two short radiating portions that are away from the two long radiating portions are respectively connected to the two end portions, and the two long radiating portions respectively extend from another ends of the two short radiating portions along two opposite directions;

wherein a quantity of the at least one soldering region is two, and wherein the two soldering regions are respectively arranged on the two short radiating portions, and are exposed from the hollow region.

* * * * *